US006186201B1

(12) United States Patent
Salz

(10) Patent No.: US 6,186,201 B1
(45) Date of Patent: Feb. 13, 2001

(54) HANDBAG WITH A REMOVABLY ATTACHED INNER BAG

(76) Inventor: Julie Salz, 5833 11th St. North, Arlington, VA (US) 22205

( * ) Notice: Under 35 U.S.C. 154(b), the term of this patent shall be extended for 0 days.

(21) Appl. No.: 09/362,218

(22) Filed: Jul. 28, 1999

(51) Int. Cl.[7] ..... A45C 13/00
(52) U.S. Cl. ..... 150/105; 150/104; 150/113
(58) Field of Search ..... 150/28, 29, 113, 150/103, 104, 105; 190/110; 224/582; 294/142

(56) References Cited

U.S. PATENT DOCUMENTS

| | | | | |
|---|---|---|---|---|
| D. 224,072 | | 6/1972 | Rosenblum . | |
| D. 403,863 | | 1/1999 | Briganti . | |
| D. 408,146 | | 4/1999 | Briganti . | |
| 840,086 | | 1/1907 | Oswald . | |
| 1,042,934 | | 9/1912 | Levy . | |
| 1,972,577 | | 9/1934 | Walinsky . | |
| 1,978,971 | * | 10/1934 | Thornhill et al. | 150/28 |
| 2,023,144 | * | 7/1935 | Miller | 150/28 |
| 2,104,439 | | 1/1938 | Schein . | |
| 2,131,382 | * | 9/1938 | Lobel | 150/28 |
| 2,464,312 | | 3/1949 | Holden . | |
| 3,234,985 | * | 2/1966 | Gilbert | 150/29 |
| 3,451,454 | | 6/1969 | Davis . | |
| 4,263,951 | | 4/1981 | Siegel . | |
| 4,610,286 | * | 9/1986 | Cyr | 190/110 X |
| 4,842,032 | * | 6/1989 | Mastronardo | 190/110 X |
| 4,907,633 | * | 3/1990 | Eckstein | 150/105 X |
| 5,096,030 | * | 3/1992 | Espinosa et al. | 190/110 X |
| 5,207,254 | * | 5/1993 | Fromm | 150/104 X |
| 5,356,004 | * | 10/1994 | Weinreb | 190/110 X |
| 5,639,138 | * | 6/1997 | Smith | 294/142 |
| 5,829,502 | * | 11/1998 | Distefano et al. | 150/113 |
| 5,894,975 | * | 4/1999 | Holden et al. | 224/582 |
| 5,911,262 | * | 6/1999 | Steinhart | 150/103 |

FOREIGN PATENT DOCUMENTS

| | | |
|---|---|---|
| 1117240 | 5/1956 | (FR) . |

* cited by examiner

*Primary Examiner*—Gary E. Elkins
(74) *Attorney, Agent, or Firm*—Shanks & Herbert

(57) ABSTRACT

A handbag is made more versatile by removably attaching an inner bag to an outer shell of the handbag. When a handbag of a different color or style is required, the inner bag can be removed from one outer shell and inserted into a second outer shell, allowing the user to change handbags without disturbing the contents of the inner bag.

20 Claims, 4 Drawing Sheets

HANDBAG WITH A REMOVABLY ATTACHED INNER BAG

BACKGROUND OF THE INVENTION

1. Field of the Invention

This present invention relates to handbags and handbag systems. More particularly, the invention relates to a handbag or handbag system that has one or more inner bags removably attached or capable of being removably attached to the outer shell o f the handbag The invention also relates to methods of using such handbags and handbag systems.

2. DESCRIPTION OF RELATED ART

Handbags are commonly used by individuals to transport a variety of personal items. A handbag may be used to carry identification, credit cards, keys, wallet, checkbook, glasses, combs tissue and the like. For many, the use of a handbag has become a necessary element in the conduct of their daily activities.

Handbags have been designed with numerous styles and designs. Different occasions or different attire may call for a particular kind or color of handbag. However, moving the contents of one handbag into a different handbag can be a tedious process. There is also a risk that something important may be left behind in an unnoticed pocket of the previous handbag. Changing handbags to suit every situation is troublesome, yet no single handbag can suffice for a wide variety of occasions.

Therefore, a need exists for a handbag or system of handbags which facilitates the exchange of contents from one handbag to another.

SUMMARY OF THE INVENTION

To meet this need, according to an aspect of the invention, there is provided a handbag system including a first outer shell having an open end; a second outer shell having an open end; at least one first fastener attached on the interior side of said first outer shell; at least one second fastener attached to the interior side of said second outer shell; an inner bag having an open end; at least one third fastener attached to the exterior of the inner bag; where when said inner bag is placed within said first or said second outer shell, the first or second fastener is capable of independently engaging the third fastener, such that the inner bag can be removably attached to the first and second outer shell.

According to another aspect of the invention, there is provided a handbag including: an outer shell having an open end; at least one first fastener attached to the interior side of said first outer shell; an inner bag having an open end; at least one second fastener attached to the exterior of the inner bag; where said inner bag is capable of being placed within said first outer shell so that the first fastener engages the second fastener, such that the inner bag can be removed from the outer shell by disengaging the first fastener from the second fastener; wherein said first and second fasteners are selected from the group consisting of hook and loop fasteners, magnetized materials, buttons and zippers.

According to another aspect of the invention, there is provided a handbag including: an outer shell having an open end; at least one first fastener attached to the interior side of said first outer shell; a first and second inner bag each having an open end; at least one second fastener attached to the exterior of the first inner bag; at least one third fastener attached to the exterior of the second inner bag, where said first and second inner bags are capable of being placed together within said outer shell so that the first fastener engages the second and third fasteners, such that the first and second inner bag can be removed from the outer shell by disengaging the first fastener from the second fastener and third fasteners, Further objects, features, and advantages of the present invention will become apparent from the detailed description that follows.

DETAILED DESCRIPTION OF PREFERRED EMBODIMENTS

The invention will now be described in more detail with reference to the embodiments shown in the accompanying figures. It should be kept in mind that the following described embodiments are only presented by way of example and should not be construed as limiting the inventive concept to any particular physical configuration.

Figure 1:
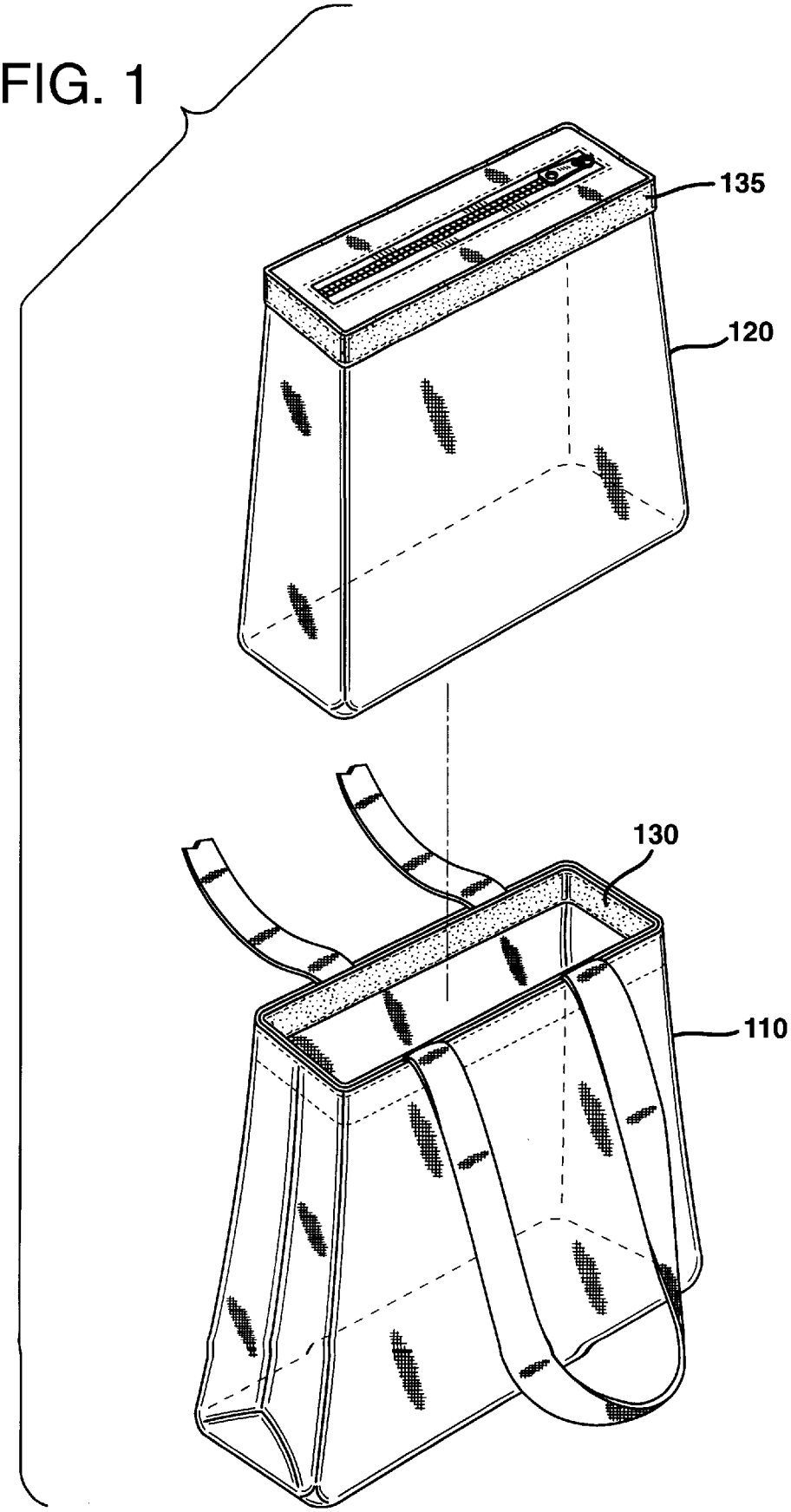
FIG. 1 illustrates a handbag including an inner and outer shell in accordance with the invention.

FIG. 1 shows a handbag with an outer shell 110 and an inner bag 120 which fits substantially inside the outer shell 110. Fasteners 130 are sewn or otherwise attached to the interior side of the outer shell 110, near the top or open end of the shell. Fasteners 135 which are connectable with the fasteners 130 of the outer shell are sewn or otherwise attached to the exterior of the inner bag 120, near the top or open end of the bag. The fasteners 130 and 135 are arranged so that when the inner bag 120 is inserted into the outer shell 110, each fastener 135 on the inner bag 120 engages a complimentary fastener 130 in the outer shell 110. The engagement of the fasteners 130 and 135 holds the inner bag 120 firmly against the outer shell 110.

While FIG. 1 shows the fasteners near or adjacent to the top of the inner and outer shells, the fasteners can be located in any position of the shells, so long as the inner and outer shells are capable of being removably attached by the fasteners. Also, while FIG. 1 shows a continues strip of fastener around the entire periphery of the inner and outer shells, a discontinuous strip or any other desired arrangement of the fasteners can be used so long as the fasteners serve to removeably connect the inner and outer shells. The inner bag can completely fill the outer bag, or only fill a desired portion thereof.

When the need to change handbags arises, the inner bag 120 can be easily removed from the outer shell 110 by disconnecting the fasteners 130 from fasteners 135. In this way, the inner bag 120 along with the entire contents of the inner bag can be transferred into another outer shell 110 of a different design or color simply by inserting and fastening the inner bag 120 into the new outer shell 110. Thus, a handbag system is provided in accordance with the invention that includes at least two outer bags and at least one inner bag.

In accordance with one aspect of the invention, the fasteners 130 and 135 are discrete units, evenly spaced around the openings of the interior bag and exterior shell. Alternatively, a continuous strip of a fastening material is arranged to form a complete or nearly complete ring around one or both openings. Preferably, the fasteners 130 and 135 are made from strips of hook & loop tape, i.e., Velcro®, that are sewn or otherwise attached to the exterior of the inner bag 120 and the outer shell 110 so that the hook tape engages the loop tape to fix the inner bag 120 inside the outer shell 10.

Figure 3:
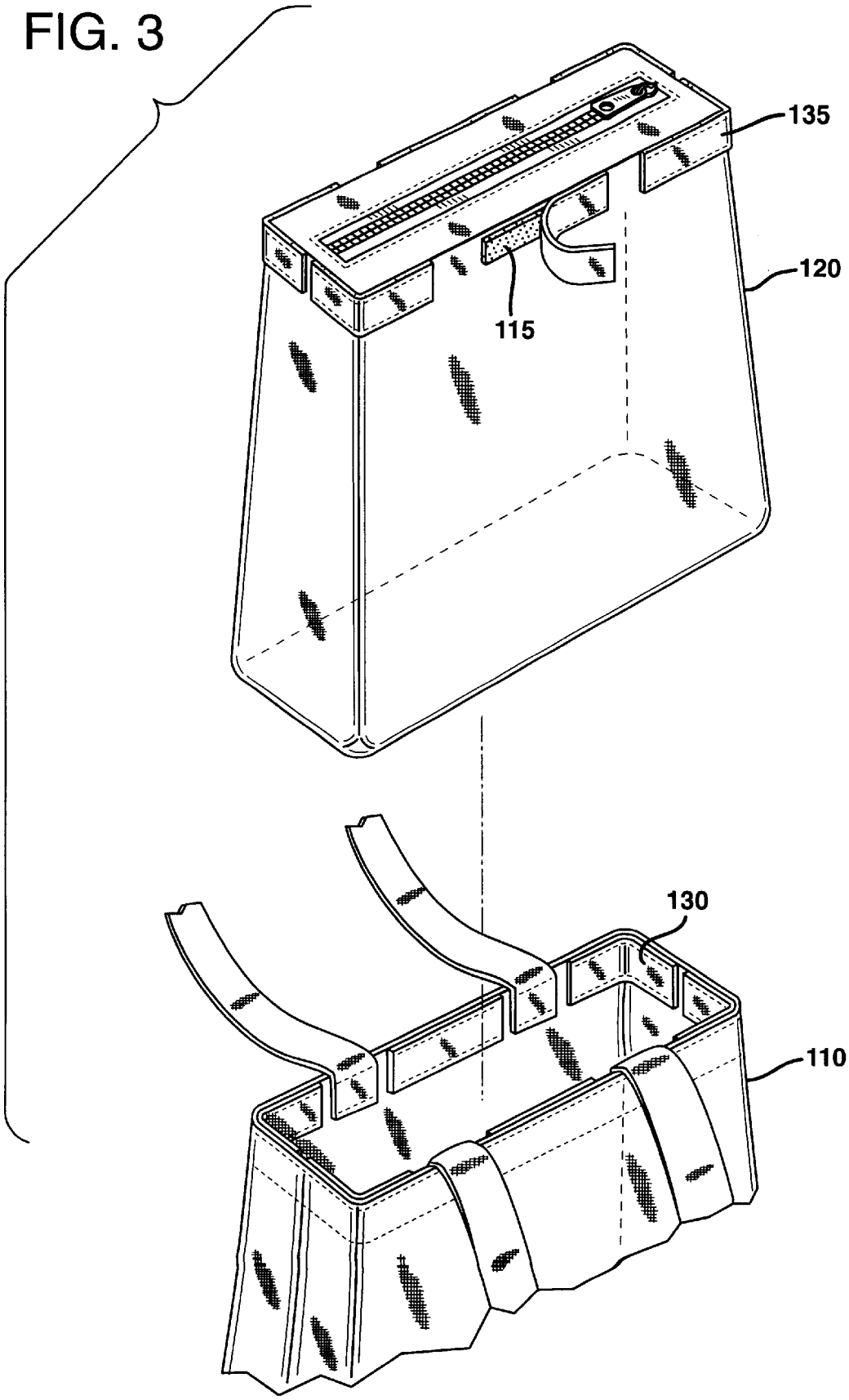
FIG. 3 illustrates a handbag including an inner and outer shell in accordance with the invention.

In accordance with another aspect of the invention shown in FIG. 3, the fasteners 130 and 135 are made from magnetic tape so that the inner bag is fixed to the outer shell by the mutual attraction of the pieces of magnet. The magnets are preferably held in place by strips of fabric 115 which are sewn to the inner bag 120 and the outer shell 110. Not shown for the outer shell. Alternatively, zippers, hooks, or buttons, could be used to fasten the inner bag to the outer shell.

Magnets and velcro are especially advantageous because they permit removal of the inner bag without having to disconnect individual fasteners.

Figure 2:
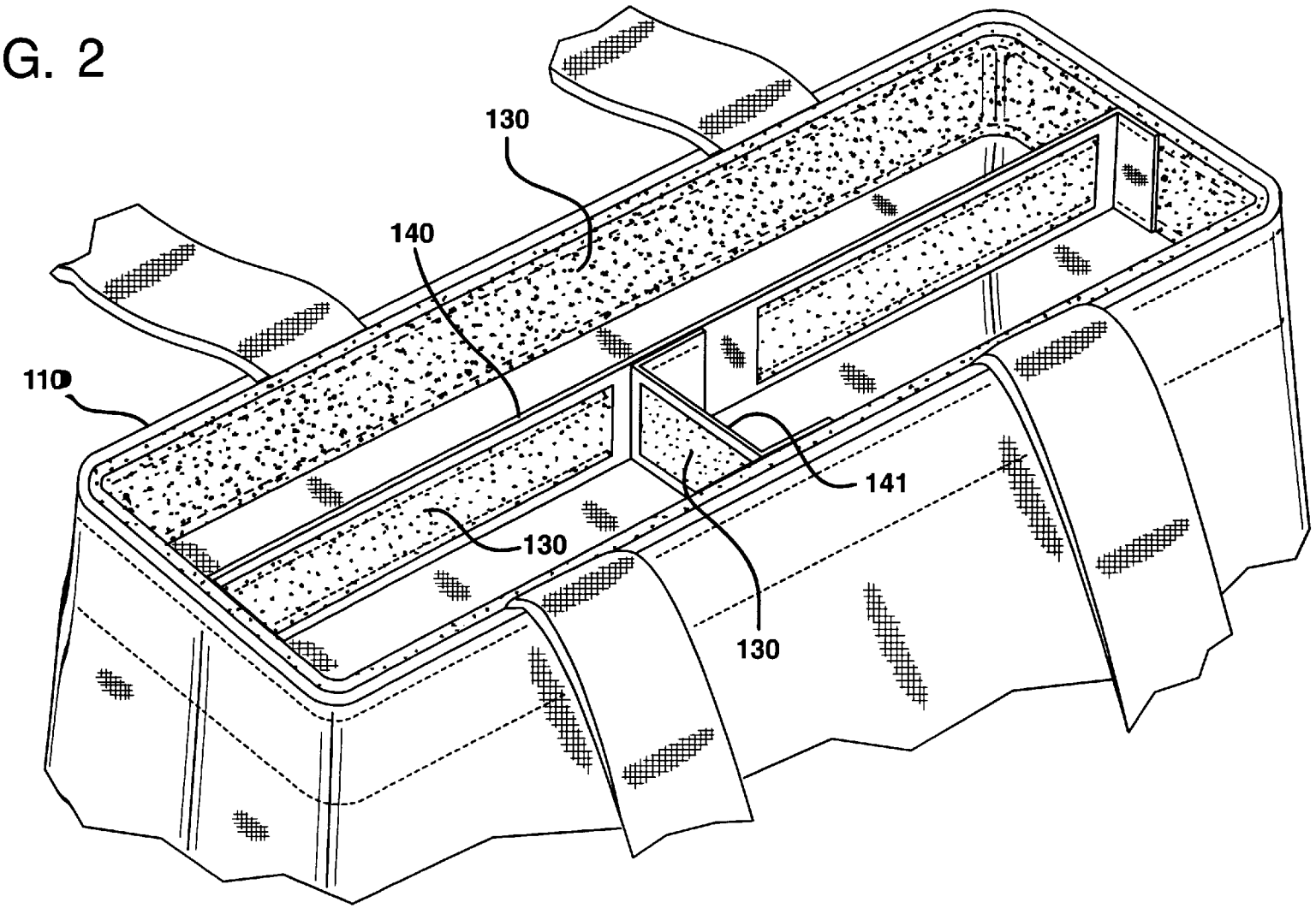
FIG. 2 illustrates an outer shell divided into multiple sections in accordance with the invention.

FIG. 2 shows an outer shell 110 in accordance with another aspect of the invention. To accommodate more than one inner bag 120 inside the outer shell 110, the opening of the outer shell 110 is divided into multiple sections. A divider 140 reaches from a side of the opening of the outer shell 110 to a side opposite, splitting the opening of the outer shell 110 into two sections. Additional dividers 141 may be used to divide the sections into smaller sections Each divider has fasteners 130 on both sides to engage the fasteners 135 of the inner bags. The arrangement of dividers 140 and 141 can be varied to accommodate specific sizes and numbers of inner bags.

Figure 4:
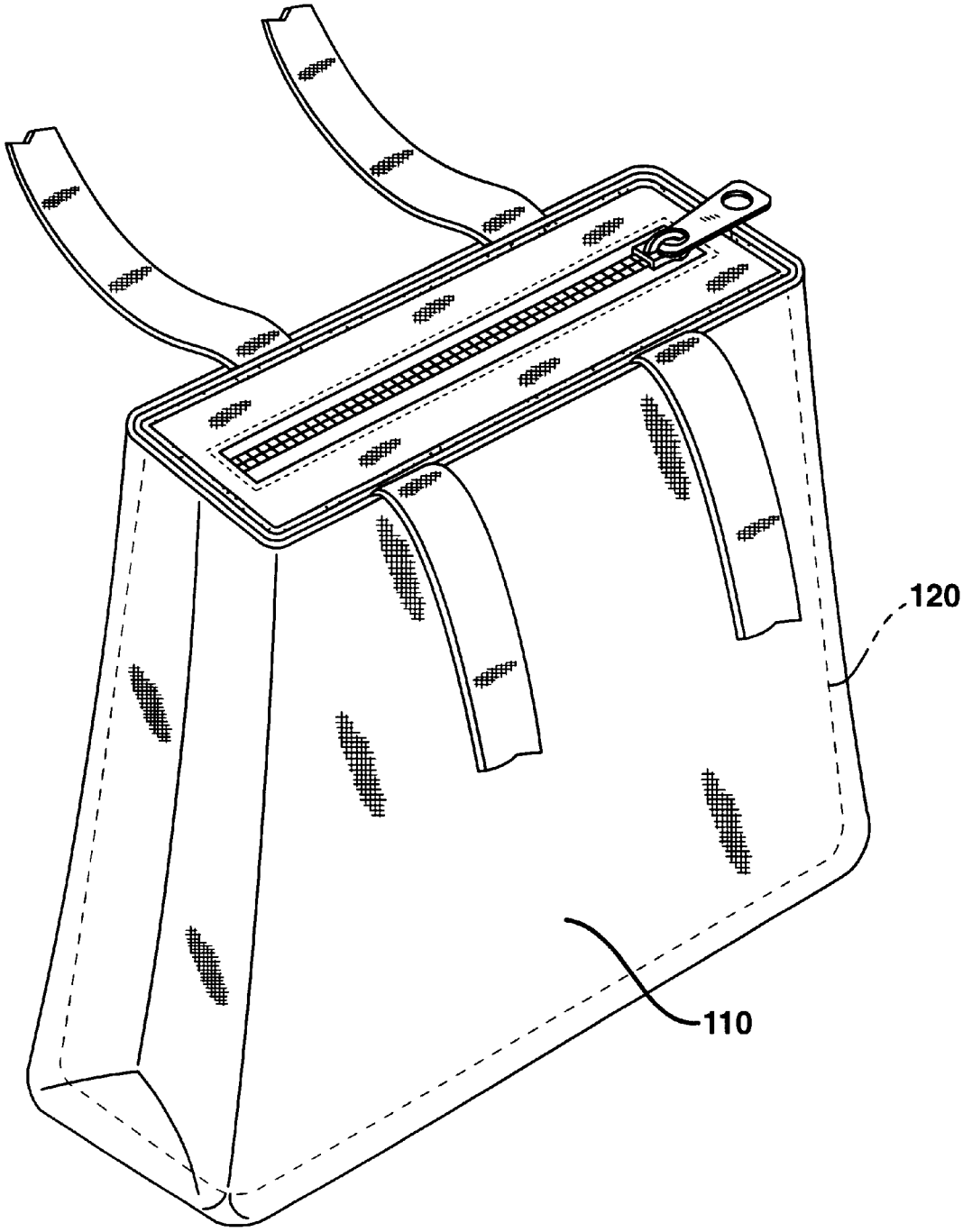
FIG. 4 illustrates a closed handbag in accordance with the invention.

FIG. 4 shows a handbag including a closed outer shell 1 10 including an inner shell 120.

It will be understood that the above described embodiment of the present invention are susceptible to various modifications, changes, and adaptations, and the same are intended to be within the meaning and range of equivalents of the appended claims.

Further, although a number of equivalent components may have been mentioned herein which could be used in place of the components illustrated and described with reference to the described embodiments, this is not meant to be an exhaustive treatment of all the possible equivalents, nor to limit the invention defined by the claims to any particular equivalent or combination thereof. A person skilled in the art would realize that there may be other equivalent components presently known, or to be developed, which could be used within the spirit and scope of the invention.

What is claimed is:

1. A handbag system comprising;

a first outer shell having an open end;

a second outer shell having an open end;

at least one first fastener attached to at least two interior surfaces of said first outer shell;

at least one first fastener attached to at least two interior surfaces of said second outer shell;

an inner bag having an open end;

at least one second fastener attached to at least two exterior surfaces of said inner bag;

where said inner bag is placed within said first or said second outer shell so that the first fastener engages the second fastener, such that the inner bag can be removed from the outer shell by disengaging the first fastener from the second fastener.

2. The handbag system according to claim 1, wherein said first, second, and third fasteners are hook and loop fasteners.

3. The handbag system according to claim 1, wherein said first, second, and third fasteners comprises magnetized material.

4. The handbag system according to claim 1, wherein said first, second, and third fasteners comprise zippers.

5. The handbag according to claim 1, wherein said open end of the outer shell is further divided into sections by dividing strips to accommodate an inner bag in each section.

6. A handbag system as in claim 1 wherein said two interior surfaces of said first outer shell comprise opposite sides of said first outer shell;

wherein said two interior surfaces of said second outer shell comprise opposite sides of said second outer shell; and wherein said two exterior surfaces of said inner bag comprise opposite sides of said inner bag.

7. A handbag system as in claim 1 wherein said interior surfaces of said first outer shell comprise four sides of said first outer shell;

wherein said interior surfaces of said second outer shell comprise four sides of said second outer shell; and wherein said exterior surfaces of said inner bag comprise four sides of said inner bag.

8. A handbag comprising:

an outer shell having an open end;

at least one first fastener attached to at least two interior surfaces of said outer shell;

an inner bag having an open end;

at least one second fastener attached to at least two exterior surfaces of said inner bag;

where said inner bag is capable of being placed within said outer shell so that the first fastener engages the second fastener, such that the inner bag can be removed from said outer shell by disengaging the first fastener from the second fastener;

wherein said first and second fasteners are selected from the group consisting of hook and loop fasteners, magnetized materials, buttons and zippers.

9. The handbag according to claim 8, wherein said first and second fasteners comprise magnetized material.

10. The handbag according to claim 8, wherein said first and second fasteners are nook and loop fasteners.

11. The handbag according to claim 8, wherein said first and second fasteners comprise zippers.

12. The handbag according to claim 8, wherein said open end of the outer shell is further divided into sections by dividing strips to accommodate an inner bag in each section.

13. A handbag as in claim 8 wherein said interior surfaces of said outer shell comprise opposite sides of said outer shell; and wherein said exterior surfaces of said inner bag comprise opposite sides of said inner bag.

14. A handbag as in claim 8 wherein said interior surfaces of said outer shell comprise four sides of said outer shell; and wherein said exterior surfaces of said inner bag comprise four sides of said inner bag.

15. A handbag comprising:

an outer shell having an open end;

at least one first fastener attached to at least two interior surfaces of said outer shell;

a first and second inner bag each having an open end;

at least one second fastener attached to at least two exterior surfaces of said first inner bag;

at least one third fastener attached to at least two exterior surfaces of said second inner bag;

where said first and second inner bags are capable of being placed together within said outer shell so that said first fastener engages said second and third fasteners, such that said first and second inner bags can be removed from said outer shell by disengaging said first fastener from said second fastener and third fastener.

16. The handbag system according to claim 15, wherein said first, second, and third fasteners are hook and loop fasteners.

17. The handbag system according to claim 15, wherein said first, second, and third fasteners comprise magnetized material.

18. The handbag system according to claim 15, wherein said first, second, and third fasteners comprise zippers.

19. A handbag as in claim 15 wherein said interior surfaces of said outer shell comprise opposite sides of said outer shell;

wherein said exterior surfaces of said first inner bag comprise opposite sides of said first inner bag; and wherein said exterior surfaces of said second inner bag comprise opposite sides of said second inner bag.

20. A handbag as in claim 15 wherein said interior surfaces of said outer shell comprise four sides of said outer shell;

wherein said exterior surfaces of said first inner bag comprise four sides of said first inner bag; and wherein said exterior surfaces of said second inner bag comprise four sides of said second inner bag.

* * * * *